US010679801B2

(12) United States Patent
Ly

(10) Patent No.: US 10,679,801 B2
(45) Date of Patent: Jun. 9, 2020

(54) METHOD AND APPARATUS FOR MECHANICAL SWITCH NOISE DAMPING

(71) Applicant: Omron Automotive Electronics Co., Ltd., Aichi (JP)

(72) Inventor: Hoang Vu Ly, Milton (CA)

(73) Assignee: Omron Automotive Electronics Co., Ltd., Aichi (JP)

( * ) Notice: Subject to any disclaimer, the term of this patent is extended or adjusted under 35 U.S.C. 154(b) by 0 days.

(21) Appl. No.: 16/176,333

(22) Filed: Oct. 31, 2018

(65) Prior Publication Data

US 2020/0135416 A1 Apr. 30, 2020

(51) Int. Cl.
*H01H 13/14* (2006.01)
*H01H 13/52* (2006.01)

(52) U.S. Cl.
CPC ..... *H01H 13/14* (2013.01); *H01H 13/52* (2013.01); *H01H 2215/008* (2013.01); *H01H 2221/062* (2013.01)

(58) Field of Classification Search
CPC .. H01H 13/14; H01H 13/52; H01H 2215/008; H01H 2221/062
USPC ..... 200/301, 341, 344, 345, 511–513, 516, 200/517, 520
See application file for complete search history.

(56) References Cited

U.S. PATENT DOCUMENTS 4,604,509 A 8/1986 Clancy et al.
5,247,143 A 9/1993 Suwa
5,990,435 A * 11/1999 Chao ..... H01H 13/702 200/345

FOREIGN PATENT DOCUMENTS

CN 2441176 Y 8/2001
FR 2993700 A1 1/2014

OTHER PUBLICATIONS

"Cherry MX Rubber O-Ring Switch Dampeners", http://www.wasdkeyboards.com/index.php/products/keyboard-accessories/cherry-mx-rubber-o-ring-switch-dampeners-125pcs.html, 3 pages.

* cited by examiner

*Primary Examiner* — Edwin A. Leon
*Assistant Examiner* — Lheiren Mae A Caroc
(74) *Attorney, Agent, or Firm* — Murphy, Bilak & Homiller, PLLC

(57) ABSTRACT

A switch assembly includes a switch housing defining an interior volume, and a switch actuator slidably retained within the switch housing. Travel in a first direction by the switch actuator compresses a resilient dome switch and a hard mechanical stop limits a full extent of return travel by the switch actuator within the switch housing. A resilient retention post, formed in a resilient switch pad that includes the resilient dome switch, for example, has a length terminating in a flanged tip that captures the switch actuator and thereby defines a restricted extent of return travel by the switch actuator. The restricted extent of return travel is less than the full extent of return travel, to prevent the resilient dome switch from springedly urging the switch actuator into contact with the hard mechanical stop.

5 Claims, 2 Drawing Sheets

METHOD AND APPARATUS FOR MECHANICAL SWITCH NOISE DAMPING

TECHNICAL FIELD

The present invention relates to noise damping in mechanical switches.

BACKGROUND

Example operation of a mechanical switch involves rectilinear movement of a switch actuator that compresses an elastic domed keypad as it slides within a switch housing, relatively speaking, in the downward direction into compressive contact with the domed keypad. "Spring" force provided by the domed keypad provides tactile feel as the user pushes down on the switch button coupled to the switch actuator. That spring force also serves an upward biasing force that returns the actuator to its topmost or "rest" position, when the user releases the switch.

In plastic switch assemblies configured according to the above details, plastic-to-plastic contact occurs between the actuator and its housing, at least in designs where the switch housing retains the actuator and defines the limit of its upward travel on the return stroke. Certain applications, such as seat-control buttons in an automotive context, disfavor the "clicking" noise produced on the return stroke of such switches. However, manufacturing constraints and the need to retain tactile feel complicate noise-reduction modifications.

SUMMARY

A switch assembly in an example embodiment includes a switch housing and an associated switch base, along with a switch actuator and a switch button. The switch actuator is configured for linear travel within an interior volume of the switch housing, in a first direction of travel towards the switch base and in an opposite, return direction of travel, away from the switch base. The switch button is configured to engage the switch actuator, for depressing the switch actuator in the first direction of travel.

A printed circuit board (PCB) positioned on the switch base has an upper surface that is at least partially overlaid by a resilient switch pad that includes a resilient dome switch having a compressible height and positioned, in relative terms, below a facing surface of the switch actuator. Depressing the switch actuator in the first direction of travel compresses the resilient dome switch, for switch actuation, and a return expansion of the resilient dome switch urges the switch actuator in the return direction of travel.

A resilient retention post projects from the resilient switch pad towards the facing surface of the switch actuator. The resilient retention post includes a shaft terminating in a flanged tip. Correspondingly, the facing surface of the switch actuator includes an aperture dimensioned for compressibly admitting the flanged tip of the resilient retention post through the aperture and thereby capturing the switch actuator on the resilient retention post.

A length of the shaft to the flanged tip fixes a travel limit of the switch actuator in the return direction of travel, to prevent spring action of the resilient dome switch from causing the switch actuator to hit a hard travel limit in the return direction of travel. Among other advantages, avoiding the hard travel limit during the return movement of the switch actuator reduces or eliminates switch noise.

In another example embodiment, a switch assembly includes a switch housing defining an interior volume, and a switch actuator that is slidably retained within the switch housing. Travel in a first direction by the switch actuator compresses a resilient dome switch, for switch actuation, and a hard mechanical stop limits a full extent of return travel by the switch actuator within the switch housing.

The switch actuator is captured by a resilient retention post formed in a resilient switch pad that includes the resilient dome switch, the resilient retention post having a length terminating in a flanged tip that captures the switch actuator and thereby defines a restricted extent of return travel by the switch actuator. The restricted extent of return travel is less than the full extent of return travel, to prevent the resilient dome switch from springedly urging the switch actuator into contact with the hard mechanical stop.

Of course, the present invention is not limited to the above features and advantages. Those of ordinary skill in the art will recognize additional features and advantages upon reading the following detailed description, and upon viewing the accompanying drawings.

DETAILED DESCRIPTION

Figure 1:
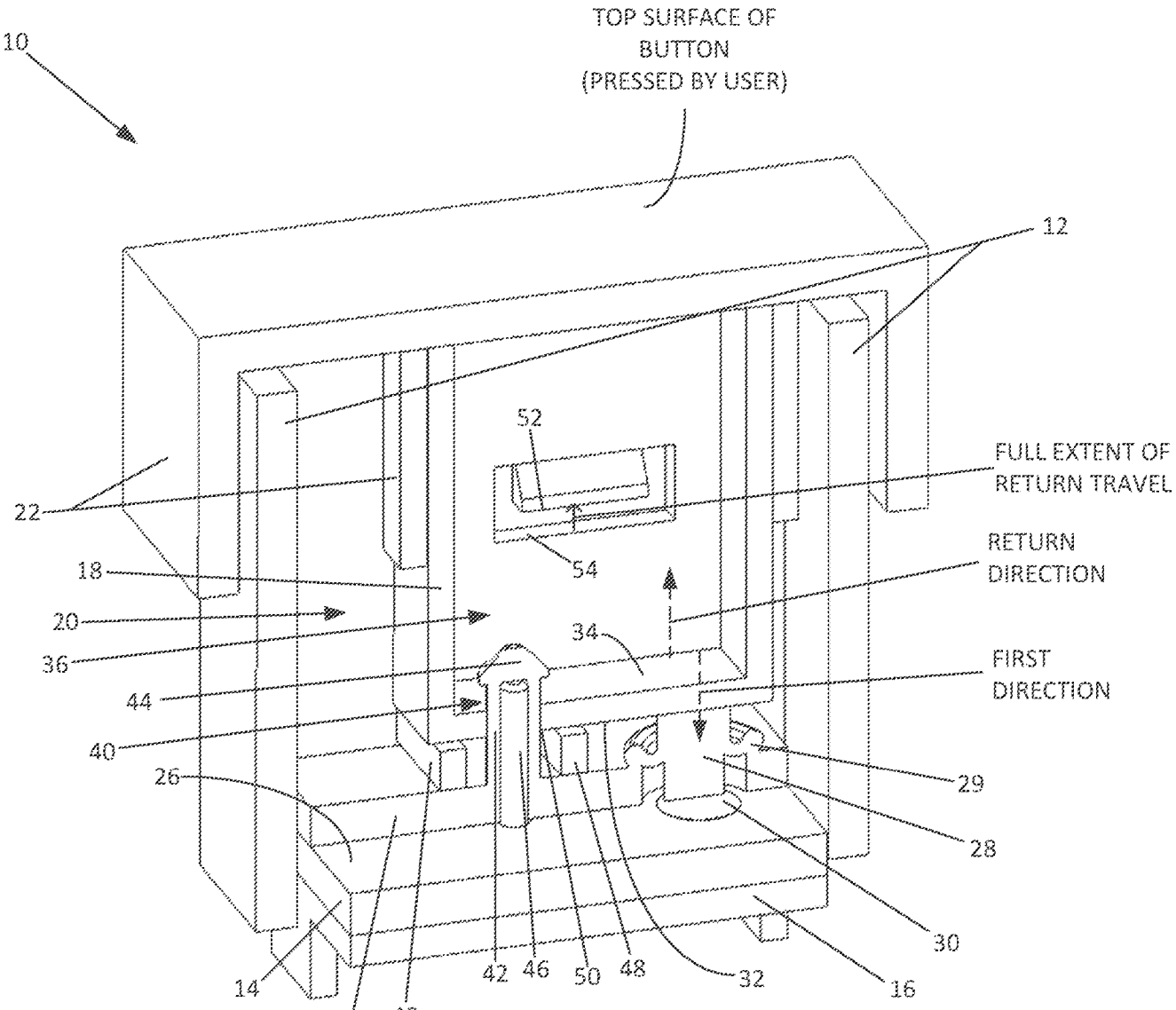
FIG. 1 is a cut-away, perspective view of one embodiment of a switch assembly.

FIG. 1 illustrates a mechanical switch assembly 10 according to an example embodiment. The switch assembly 10 includes a switch housing 12 and an associated switch base 16. Further included are a switch actuator 18 configured for linear travel within an interior volume 20 of the switch housing 12, in a first direction of travel towards the switch base 16 and in an opposite, return direction of travel, away from the switch base 16. The switch housing includes grooves, rails, or other guiding features molded into its interior, for example, to guide linear travel of the switch actuator 18.

A switch button 22 is configured to engage the switch actuator 18, for depressing the switch actuator 18 in the first direction of travel. Thus, in its installed configuration, the switch assembly 10 provides push-button operation, wherein a user actuates the switch assembly 10 by pressing on the switch button 22.

A printed circuit board (PCB) 14 positioned on the switch base 16 has an upper surface 26 that is at least partially overlaid by a resilient switch pad 24 that includes a resilient dome switch 28 having a compressible height and positioned, in relative terms, below a facing surface 32 of the switch actuator 18. "Upper" as used herein operates in a relative sense, in the context of the switch assembly 10, to denote a surface that is facing the "lower" or "bottom" surface 32 of the switch actuator 18. Consequently, the terms "upper" and "lower" do not imply anything about the absolute orientation of the overall switch assembly 10.

Depressing the switch actuator 18 in the first direction of travel compresses the resilient dome switch 28, for switch actuation. That is, a user pressing the switch button 22 forces the switch actuator 18 to press on the resilient dome switch 28, which includes a flexible web member 29 that collapses and allows a center cylindrical portion of the resilient dome switch 28 to close an electrical contact 30 on the PCB 14.

FIG. 1 shows the resilient dome switch 28 in its compressed state or position, with the understanding that when the user stops pressing on the switch button 22, the resilient dome switch 28 expands upward, relatively speaking, back into its expanded or un-collapsed state. The return expansion of the resilient dome switch 28 urges the switch actuator 18 in the return direction of travel. That is, upon the user removing pressure from the switch button 22, the natural spring force of the resilient dome switch 28—e.g., an elastomeric material—urges the switch actuator 18 in the return direction of travel, which "opens" the connection across the electrical contact 30 and returns the switch actuator 18 to a "rest" position for the next user actuation.

However, rather than allowing the springing return of the resilient dome switch 28 to drive the switch actuator 18 in the return direction to the fullest extent allowed by a "hard" travel limit—which is fixed as a matter of the switch assembly design—the switch assembly 10 includes a resilient retention post 40 that limits the return travel of the switch actuator 18. The resilient retention post 40 projects from the switch base 16, or from the resilient switch pad 24.

In the example embodiment shown in FIG. 1, the resilient retention post 40 is an integral part of the resilient switch pad 24 and it includes a shaft 42 terminating in a flanged tip 44. The resilient retention post 40 projects towards the facing surface 32 of the switch actuator 18. At least a portion of the resilient retention post 40 may be hollow, such that the resilient retention post 40 fits over an inner, stiffening post 46. The stiffening post 46 may be integral to the PCB 14, or otherwise fixed to the PCB 14, or it may be part of or fixed to the switch base 16 and, e.g., pass through a hole or slot in the PCB 14.

In any case, the stiffening post 46 offers a number of advantages, including ensuring alignment of the resilient retention post 40 with a corresponding aperture 50 in the facing surface 32 of the switch actuator 18, when the switch actuator 18 is aligned within the interior volume 20 of the switch housing 12, in the assembled form of the switch assembly 10. The stiffening post 46 also keeps the resilient retention post 40 straight, during downward travel of the switch actuator 18, as part of normal switch operation.

As a further feature, the switch assembly 10 may include one or more "stops" 48 that define the lower extent of travel permitted in the first direction of travel. The height of the stops 48 in the direction of travel is fixed to define a maximum compressive position for the resilient dome switch 28—e.g., low enough to allow a desired extent of compression of the resilient dome switch 28 and high enough to limit further compression of the resilient dome switch 28. The stops 48 may be formed on or as part of the resilient switch pad 24 and may be made of the same resilient material.

Figure 2:
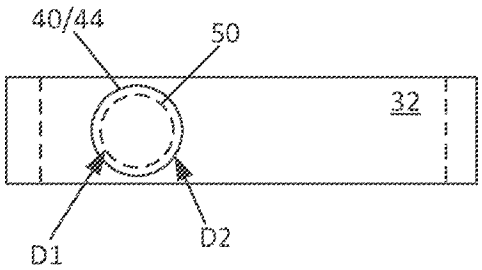
FIG. 2 is a bottom view of a facing surface of the switch actuator included in the switch assembly, for capturing a compressible tip of a resilient retention post included in the switch assembly.

FIG. 1 also indicates an aperture 50 on the facing surface 32 that is dimensioned for compressibly admitting the flanged tip 44 of the resilient retention post 40 and thereby capturing the switch actuator 18 on the resilient retention post 40. To better understand the initial capture operation, FIG. 2 illustrates the facing surface 32 of the switch actuator 18, where the diameter D1 of the aperture 50 is smaller than the diameter D2 of the flanged tip 44 of the resilient retention post 40.

The flanged tip 44 is tapered in the insertion direction, which allows it to be forced through the aperture 50, e.g., as part of an initial assembly process. However, once the flanged tip 44 passes through the aperture 50, it re-expands within the interior volume 36 of the switch actuator 18 and the flat circumferential underside of the flanged tip 44 prevents it from easily passing back through the aperture 50 in the opposite direction.

Figure 3:
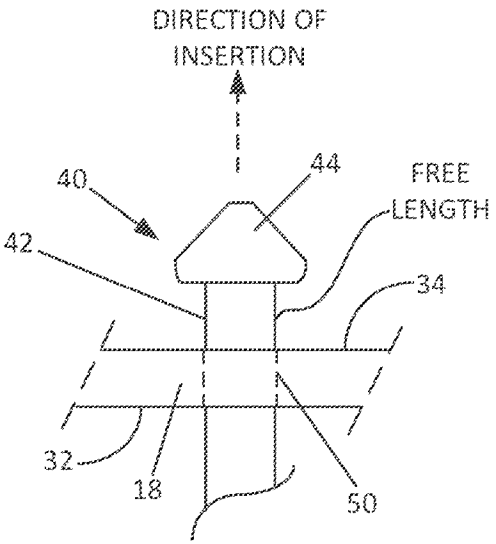
FIG. 3 is a side view of one embodiment of the resilient retention post.

FIG. 3 provides a detailed view of the flanged tip 44 of the resilient retention post 40, after insertion through the aperture 50. FIG. 3 assumes that the switch actuator 18 is in its furthest normal position in the first direction of travel, e.g., in the position along the first direction of travel that corresponds to the fully compressed state of the resilient dome switch 28, as might be achieved by a user pressing the switch button 22 until the facing surface 32 of the switch button 22 reaches the stops 48.

In that position, the resilient retention post 40 includes a "free length" of the shaft 42 extending between the interior surface 34 of the switch actuator 18 and the circumferential flat underside of the flanged tip 44. The free length defines the extent of return travel permitted for the switch actuator 18, upon the user removing pressure from the switch button 22 and the corresponding, springing re-expansion of the resilient dome switch 28.

Broadly, the length of the shaft 42 to the flanged tip 44 fixes a travel limit of the switch actuator 18 in the return direction of travel, to prevent spring action of the resilient dome switch 28 from causing the switch actuator 18 to hit a hard travel limit in the return direction of travel. As seen in FIG. 1, the switch assembly 10 includes a hard mechanical stop 52, and the switch actuator 18 includes a corresponding catch 54. The hard mechanical stop 52 and the catch 54 cooperate to provide the hard travel limit of the switch actuator 18 in the return direction of travel, for the illustrated embodiment of the switch assembly 10.

The shaft length of the resilient retention post 40 is dimensioned to prevent the switch actuator 18 from reaching the hard travel limit on its return stroke. That is, the shaft length is such that the interior surface 34 of the switch actuator 18 encounters the circumferential underside of the flanged tip 44 of the resilient retention post 40 before the catch 54 of the switch actuator 18 hits the underside of the hard mechanical stop 52. As best seen in FIG. 2, the hard mechanical stop 52 comprises, in one or more embodiments a beveled projection formed in an interior sidewall of the switch housing 12, the direction of the bevel allows the switch actuator 18 to slide in the first direction of travel, over the hard mechanical stop 52, until snapping through an opening or "window" within a sidewall of the switch actuator 18. The lower lip or edge of the opening forms the catch 54.

Figure 4:
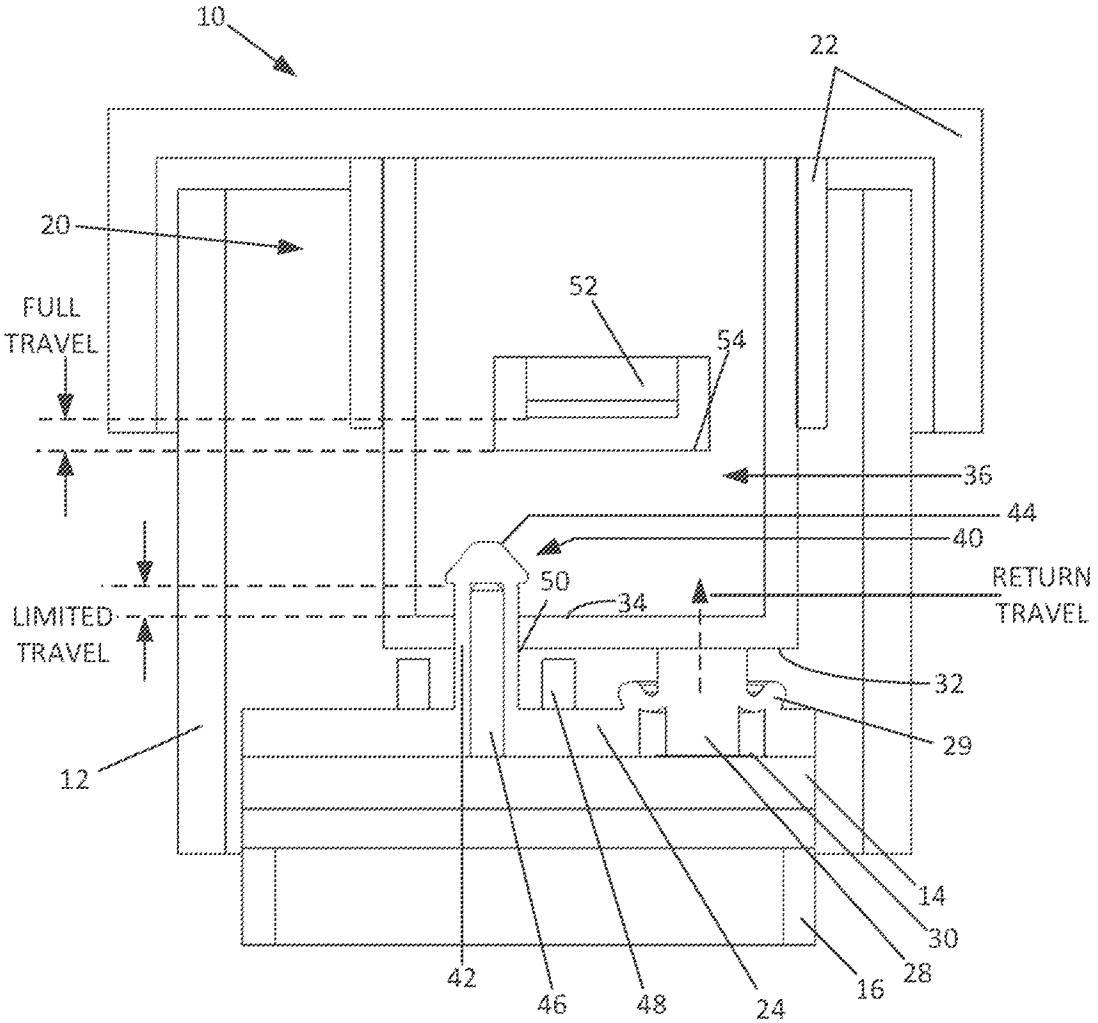
FIG. 4 is a cut-away, front view of the switch assembly.

FIG. 4 illustrates how the resilient retention post 40 affects the operation of the switch assembly 10. Going in the return direction of travel from the lowest position of the switch actuator 18—maximum compression of the resilient dome switch 28—the vertical distance from the catch 54 to the lower edge or bottom of the mechanical stop 52 defines the full extent of return travel permitted for the switch actuator. However, rather than allowing the spring force of the resilient dome switch 28 to drive the switch actuator 18 the full extent of travel in the return direction, the resilient retention post 40 imposes a limited travel in the return direction, thereby preventing the spring force of the resilient dome switch 28 from driving the switch actuator into the mechanical stop, upon the user releasing the switch button 22.

In the same or another embodiment of the switch assembly 10, the switch assembly 10 comprises a switch housing 12 defining an interior volume 20, and a switch actuator 18 slidably retained within the switch housing. Travel in a first direction by the switch actuator 18 compresses a resilient dome switch 28, for switch actuation, and a hard mechanical stop 52 limits a full extent of return travel by the switch actuator 18 within the switch housing 12.

The switch actuator 18 is captured by a resilient retention post 40 formed in a resilient switch pad 24 that includes the resilient dome switch 28, where the resilient retention post 40 has a length terminating in a flanged tip 44 that captures the switch actuator 18 and thereby defines a restricted extent of return travel by the switch actuator 18. The restricted extent of return travel being less than the full extent of return travel, to prevent the resilient dome switch 28 from springedly urging the switch actuator 18 into contact with the hard mechanical stop 52.

Notably, modifications and other embodiments of the disclosed invention(s) will come to mind to one skilled in the art having the benefit of the teachings presented in the foregoing descriptions and the associated drawings. Therefore, it is to be understood that the invention(s) is/are not to be limited to the specific embodiments disclosed and that modifications and other embodiments are intended to be included within the scope of this disclosure. Although specific terms may be employed herein, they are used in a generic and descriptive sense only and not for purposes of limitation.

What is claimed is:

1. A switch assembly comprising:

a switch housing and an associated switch base;

a switch actuator configured for linear travel within an interior volume of the switch housing, in a first direction of travel towards the switch base and in an opposite, return direction of travel, away from the switch base;

a switch button configured to engage the switch actuator, for depressing the switch actuator in the first direction of travel;

a printed circuit board (PCB) positioned on the switch base and having an upper surface that is at least partially overlaid by a resilient switch pad that includes a resilient dome switch having a compressible height and positioned, in relative terms, below a facing surface of the switch actuator, wherein depressing the switch actuator in the first direction of travel compresses the resilient dome switch, for switch actuation, and wherein a return expansion of the resilient dome switch urges the switch actuator in the return direction of travel; and a resilient retention post projecting from the resilient switch pad towards the facing surface of the switch actuator;

the resilient retention post comprising a shaft terminating in a flanged tip that is tapered and the facing surface of the switch actuator including an aperture dimensioned for compressibly admitting the flanged tip of the resilient retention post through the aperture and thereby capturing the switch actuator on the resilient retention post; and wherein a length of the shaft to the flanged tip fixes a travel limit of the switch actuator in the return direction of travel, to prevent spring action of the resilient dome switch from causing the switch actuator to hit a hard travel limit in the return direction of travel.

2. The switch assembly of claim 1, wherein the switch housing includes a hard mechanical stop, and the switch actuator includes a corresponding catch, the hard mechanical stop and the catch cooperating to provide the hard travel limit of the switch actuator in the return direction of travel.

3. The switch assembly of claim 1, wherein the resilient retention post is integral with the resilient switch pad.

4. The switch assembly of claim 1, where the switch base includes a stiffening post projecting from a top surface of the switch base towards the facing surface of the switch actuator, and wherein the shaft of the resilient retention post is hollow within at least a portion of its length, for fitting the resilient retention post over the stiffening post.

5. A switch assembly comprising:

a switch housing defining an interior volume; and a switch actuator slidably retained within the switch housing, where travel in a first direction by the switch actuator compresses a resilient dome switch, for switch actuation, and where a hard mechanical stop limits a full extent of return travel by the switch actuator within the switch housing; and wherein the switch actuator is captured by a resilient retention post formed in a resilient switch pad that includes the resilient dome switch, the resilient retention post having a length terminating in a flanged tip that is tapered for compressible admission through an aperture of the switch actuator to thereby capture the switch actuator and define a restricted extent of return travel by the switch actuator, the restricted extent of return travel being less than the full extent of return travel, to prevent the resilient dome switch from springedly urging the switch actuator into contact with the hard mechanical stop.

* * * * *